United States Patent [19]

Hogg, Jr. et al.

[11] 4,451,926

[45] May 29, 1984

[54] COMPOSITE ELECTRODE FOR ARC FURNACE

[75] Inventors: Grady R. Hogg, Jr., Elizabethton; Nathan S. Tanner, Johnson City, both of Tenn.

[73] Assignee: Great Lakes Carbon Corporation, New York, N.Y.

[21] Appl. No.: 404,827

[22] Filed: Aug. 3, 1982

[51] Int. Cl.[3] ..... H05B 7/08

[52] U.S. Cl. ..... 373/93

[58] Field of Search ..... 373/91, 92, 93, 90

[56] References Cited

U.S. PATENT DOCUMENTS 3,476,861 11/1969 Wolf ..... 373/90

*Primary Examiner*—Roy N. Envall, Jr.

*Attorney, Agent, or Firm*—Adrian J. Good

[57] ABSTRACT

A composite electrode for an electric arc smelting furnace has a metal liquid cooled upper clamped section, a consumable graphite lower section and a metal liquid cooled connecting pin. The upper section is fitted with loosely fitting arcuate graphite segments (46) over the area of the electrode held in the electrode power clamp during furnace operation.

5 Claims, 5 Drawing Figures

COMPOSITE ELECTRODE FOR ARC FURNACE

DESCRIPTION

BACKGROUND OF THE INVENTION

1. Field of the Invention

The invention relates generally to an electrode for arc furnaces, and particularly to a composite electrode comprising a liquid-cooled non-consumable upper portion and a consumable tip portion joined to the upper portion by liquid-cooled connection means.

2. Description of the Prior Art

The conventional material employed for the fabrication of electrodes for arc furnaces is graphite. These electrodes are consumed in use due to erosion and corrosion caused by oxidation, vaporization, spalling and other factors. This consumption involves tip losses, column breakage losses and particularly side oxidation losses. An average electric furnace consumes four to eight kilograms of graphite per ton of steel produced.

One method for reducing the consumption of graphite electrodes in arc furnaces has been the application of a protective coating or cladding material to the electrodes with oxidation resistant materials. These coatings generally increase the contact resistance to the electrode clamp, and some are corrosive, as they are based on phosphoric acid. Consequently, they have not found wide acceptance.

Another means for reducing graphite electrode consumption involves the utilization of fully non-consumable electrode systems. The systems employ full length fluid-cooled electrodes with selected apparatus to protect the electrode tip from the extreme temperatures of the arc. Although such systems appear in patent literature, this design has not been commercially successful.

It has been suggested heretofore that composite electrodes comprising carbon or graphite portions attached to a water-cooled metallic piece would provide means for reducing electrode consumption in arc furnaces. A number of patents have issued on specific composite electrode designs. For example, U.S. Pat. No. 2,471,531 to McIntyre et al.; U.S. Pat. No. 3,392,227 to Ostberg; U.S. Pat. Nos. 4,121,042 and 4,168,392 to Prenn; U.S. Pat. Nos. 4,189,617 and 4,256,918 to Schwabe et al.; and U.S. Pat. No. 4,287,381 to Montgomery relate to liquid cooled composite electrodes for arc furnaces. Likewise, European patent applications by C. Conradty Nurnberg designated Nos. 50,682; 50,683; and 53,200 are directed to composite electrode configurations.

OBJECTS OF THE INVENTION

It is an objective of the invention to provide an improved composite electrode for arc furnaces.

It is a further objective of the invention to provide a composite electrode wherein consumption of the graphite portion is substantially reduced.

It is a still further objective of the invention to provide a composite electrode which is able to resist the harsh environment of an arc furnace and thereby have a long useful life.

SUMMARY OF THE INVENTION

The invention is essentially comprised of a metal tubing main structure with a hollow metal female socket attached at its lower end, cooling liquid inlet and outlet ports or pipes at its top end, a central cooling liquid supply reservoir cylinder occupying the majority of the internal volume of the main tube terminated at its lower end by a header having a central port fitted with tubing leading to the interior of a hollow nipple threaded into the female socket. Cooling liquid enters the electrode through an inlet tube in the upper end plate, passing into the central reservoir, which acts as a water supply and heat sink, out of the tubing at the lower end into the hollow metal nipple. The coolant then passes back out of the nipple into the space between the upper face of the socket and the lower face of the header (which forms the lower end of the internal cylinder), into the annulus between the central internal cylinder and the main structure and out of the electrode through outlet ports in the upper end plate. The preferred coolant is water, suitably treated to avoid scale deposition and corrosion by commercially available chemical and electrical treatment, not forming part of this invention.

The main structure is protected against heat by two types of refractory rings, preferably of graphite. The graphite rings around the major upper portion of the main tube are arcuate vertically segmented pieces with an inside diameter approximately equal to the outside diameter of the main tube. They are held in place by circular beveled rings in a loose fit such that when the electrode power clamp is applied to that section, good electrical conductivity results between the clamp, the graphite, and the main structure tubing. When that particular horizontal section is unclamped these segments fall away from the wall of the tube and define an air gap providing added thermal insulation to the tubing.

The lower portion of the electrode, which is never clamped, is protected from radiant heat and electrical arc shorting by a series of graphite rings encircling the electrode. These are held in place by a metal retaining ring located at the lower end of the female nipple socket fitting a notch in the lower inside diameter of the graphite rings. Each of these is loosely fitted, thus if the bottom one of these rings is damaged, the next one above will slip down on the ring to replace it.

DETAILED DESCRIPTION OF THE INVENTION

Figure 1:
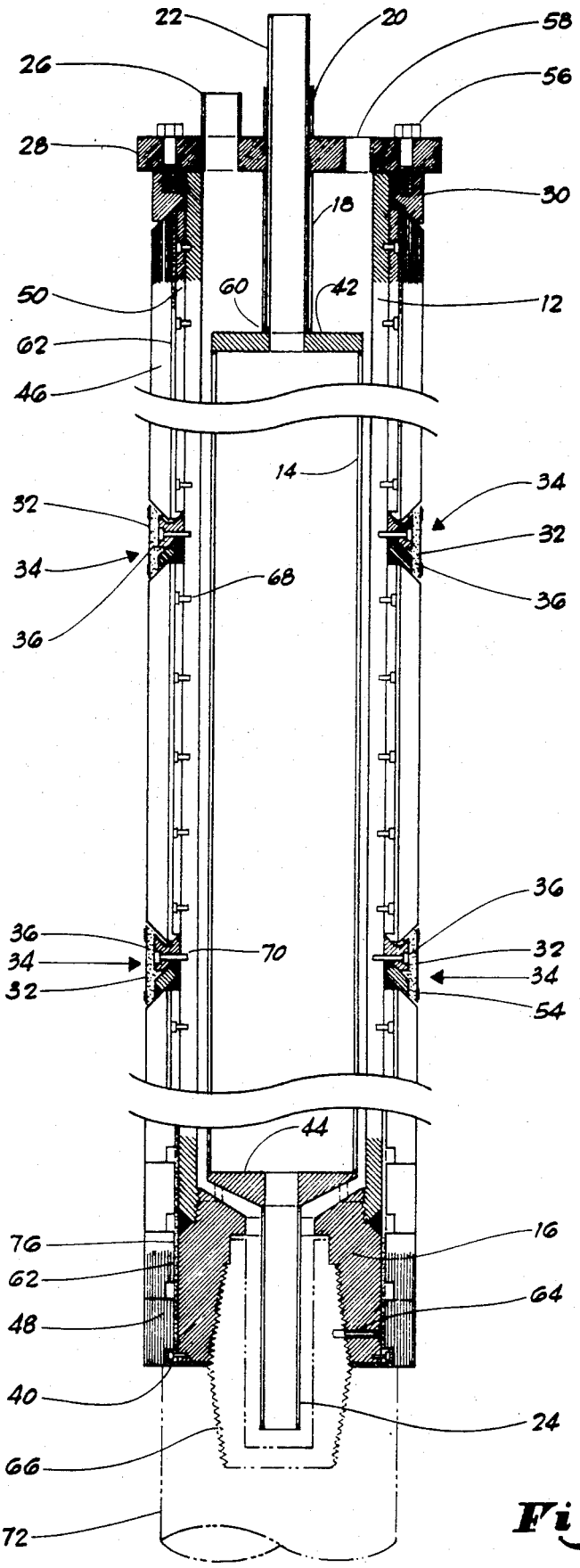
FIG. 1 is a cross section of one embodiment of the invention.

The invention has as its main structure a single piece of heavy-walled metal tubing. This tubing must have sufficient mechanical strength to support the graphite lower section and must be able to withstand the mechanical stresses in the arc furnace where falling scrap, rough handling and mishandling are normal hazards, and must also transmit the arc current to the graphite electrode without excessive losses due to resistance heating. Aluminum alloy was used due to its favorable combination of conductivity and strength-weight ratio. It is also possible to use steel tubing, which introduces a severe penalty in resistance heating, or copper, which has an unfavorable strength-weight ratio. Another possible choice would be a copper-clad steel tube, possibly one made with an explosively bonded combination. Aluminum is the preferred material of construction. Other more exotic metals, e.g., titanium, might perform well but would be too expensive for this application.

The upper end of the main tube has an end plate featuring a coolant inlet and one or more outlets. The end plate is welded to the tubing and sealed with O-rings, as are all of the joints in the structure. In this instance the coolant inlet is a piece of tubing passing through the center of the end plate continuing downwardly a relatively small distance until it joins a central internal cylinder having a relatively thin wall and occupying the major part of the volume of the main structure. This internal cylinder serves as part of the coolant supply and reservoir for coolant, as well as a heat sink for absorbed conductive and radiant heat. The internal cylinder is held firmly in place by spacers between it and the main structure wall, and at its lower end by spacers between the lower end plate or header and the nipple socket.

The lower end of the main tube has a cast aluminum female nipple socket with the same external diameter as the main tube solidly mounted thereto by a weld and by a threaded section engaging the correspondingly threaded lower end of the inner wall of the tubing. In this instance the nipple is a hollow copper casting for good heat transfer. The nipple has a bi-frusto-conical shape; however, a straight sided nipple could be used since nipple breaks should not be a problem, as it is with graphite nipples. This nipple is permanent, or semi-permanent in comparison to graphite. The nipple is pinned into place in the socket.

The face of the nipple socket has a plate of copper explosively bonded in place to facilitate electrical conductivity across the interface, although most of the current will pass through the copper nipple to the graphite electrode.

The lower end of the internal cylinder is terminated by a thick heavy plate or header having a cooling outlet tube which terminates inside the hollow nipple, with either an open end or with side openings to increase the flow velocity at the interior side walls.

The coolant enters the electrode through the top inlet, passes through the internal cylinder and into the nipple, and back up out of the nipple into the annulus between the top of the nipple socket and the lower plate of the internal cylinder, then through the annulus between the two cylinders and back out the outlet or outlets in the upper end plate.

The portion of the main cylinder held by the power clamp, carrying the arc current and holding the electrode in place during operation, is covered by loosely fitting arcuate graphite segments, each preferably covering 60° of the circumference, and held in place by circular retaining rings. The bottom and top of each segment are beveled, and the retaining rings have complementary bevels, with the whole dimensioned such that when any section of the electrode is not in the clamp, the graphite segments fall back due to the camming action of the bevels from the tubing wall a short predetermined distance, leaving an air space between the graphite and the tubing wall for extra insulation. Compressible and electrically conductive insulation material may be placed in this air space if desired.

The retaining rings are protected against heat by inorganic fiber insulation, such as carbon or silicate fiber, and covered with highly reflective bands, here stainless steel, to protect the rings.

The lower unclamped area of the electrode is covered with a series of graphite rings, which protect the socket area from radiation, slag, arc shorting, and mechanical damage which occur in the arc furnace. These rings are loose-fitting, have the same outside diameter as the clamping section segments, and are held in place by a retaining ring at the lower end of the socket, which fits a notch in the lower inner diameter of the rings. If the bottom ring, which is most likely to be damaged, falls off, the rings above it will slip down to protect the area of most danger. If an arc occurs between a piece of scrap and the composite electrode, the metal is protected against melting by the graphite rings, which diffuse the current and the heat produced.

The main cylinder is fitted with vertical ribs which fit into matching notches on the arcuate graphite segments. These hold the segments in place against shifting when torque is applied during removal and replacement of the graphite lower electrodes. They also strengthen the main tubing.

DESCRIPTION OF THE DRAWINGS

FIG. 1 shows cylindrical main structure 12, in this instance a heavy-walled aluminum tube, internal cylinder 14, female socket 16, spacer tube 18, inlet reinforcement tube 20, cooling liquid inlet tube 22, cooling liquid outlet tube 24, cooling liquid outlet pipe 26, upper head plate 28 held in place by bolt 56, upper metal ring 30 having a retaining wedge angle, insulating bands 32, a radiation-reflective metal foil type, retaining ring assembly 34 held by cap screw 70 and covered with inorganic fiber insulation 36 such as graphite felt or Fiberfrax® silicate fiber, contact ring 40 being a copper washer explosively bonded to the lower socket face providing good electrical conductivity between the socket 16 and the graphite electrode 72, internal cylinder top plate 42 and bottom plate 44, arcuate graphite segments 46, refractory insulating rings 48, metal strip or vertical rib 50 held by cap screw 68, edge crimped retaining band 54, cooling liquid outlet 58, cooling liquid tube O-ring 60, carbon felt insulation or air gap 62, covered by reflective foil 76, dowel pin 64 holding nipple 66 in place.

Figure 2:
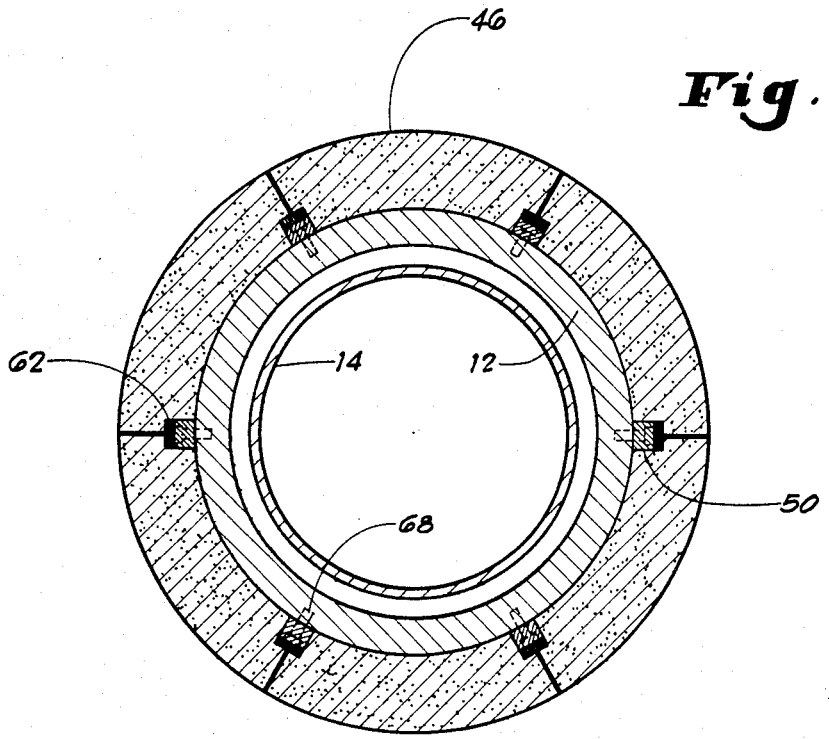
FIG. 2 is a horizontal cross section of the FIG. 1 embodiment.

FIG. 2 is a horizontal cross section showing main structural tube 12, internal cylinder 14, graphite segments 46 in the contact position, vertical ribs 50 and cap screws 68, holding the graphite segments from movement when the column is being changed.

Figure 3:
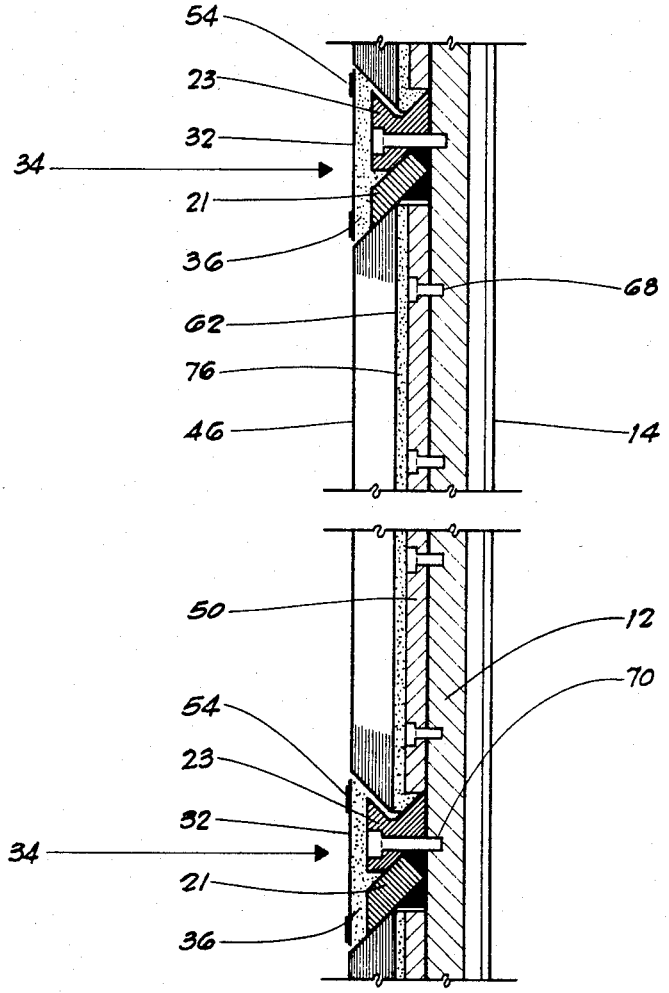
FIG. 3 is an enlarged detail of FIG. 1.

FIG. 3 is an enlarged detail showing main structure tube 12, internal cylinder 14, retaining ring assembly 34 with reflective insulating band 32, cap screw 70, top bevel retaining ring 21, bottom bevel retaining ring 23, inorganic fiber insulation 36, here a carbon fiber felt, graphite segment 46, vertical rib 50, and edge crimped retaining band 54. In this drawing graphite segments are free of pressure and have fallen away from the main tube 12 leaving an insulating air gap 62, which may be covered with foil 76. The carbon or silicate fiber insulation 36 is bonded in place by high temperature-resistant adhesives of the sodium silicate class.

Figure 4:
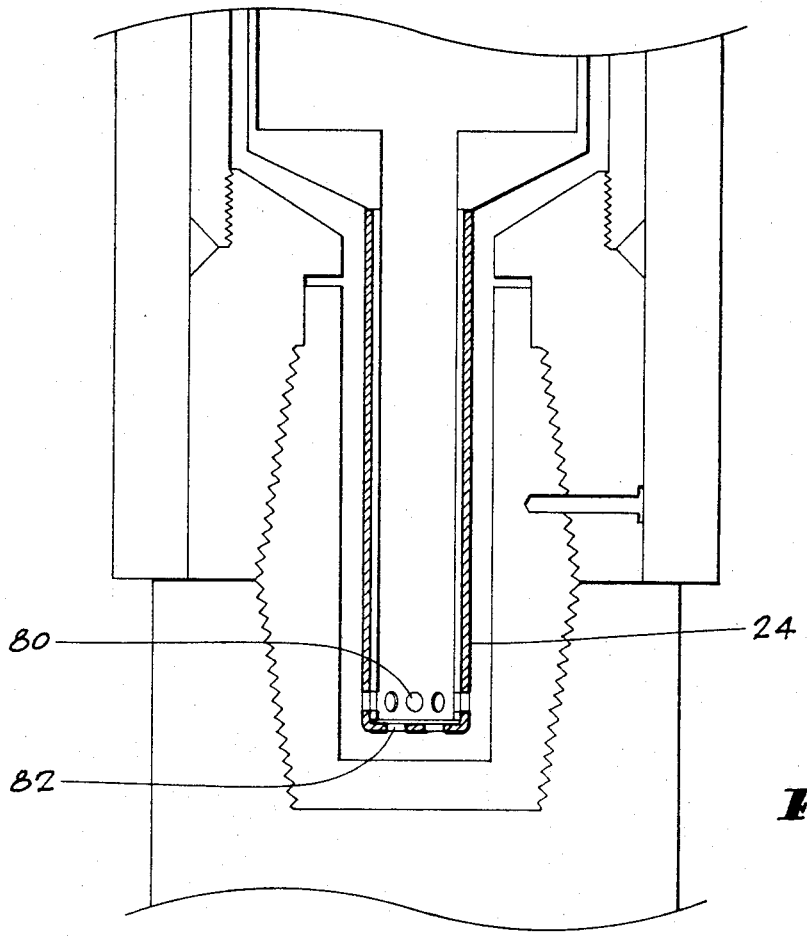
FIG. 4 is an alternate embodiment of the electrode socket area.

FIG. 4 shows an alternate version of the electrode socket area with lower cooling liquid outlet tube 24 with side liquid ports 80 and bottom liquid ports 82, directing the coolant flow in a ratio of 80% generally horizontally and 20% downward.

Figure 5:
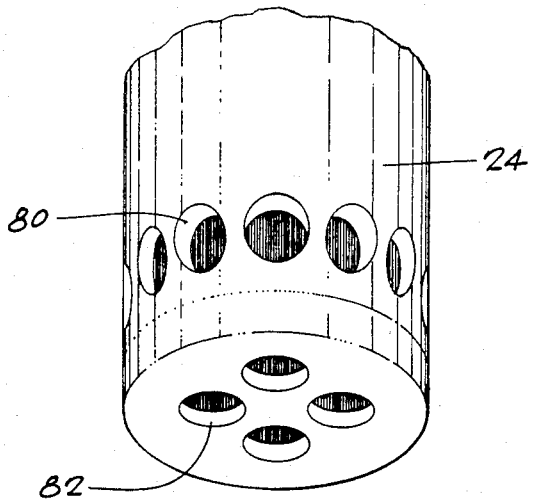
FIG. 5 is an enlargement of a portion of FIG. 4.

FIG. 5 is an enlarged detail of outlet tube 24 showing ports 80 and 82.

I claim:

1. In a composite liquid-cooled arc furnace electrode comprising a metal cylindrical upper section, a metal connecting nipple, and a graphite lower section, the improvement comprising arcuate graphite segments protecting the exterior of said upper section, the top and bottom of said segments being beveled and held in place by circular metal rings having a complementary bevel angle to said segments and attached to said upper section in a relationship such that when a force is applied radially inward to said segments a mechanical and electrical bond is established between said segments and said upper section thereby providing an electrical current path into said electrode, the dimensions of said segments being such that when no radial force is applied, said segments fall away from said upper section a predetermined radial distance, leaving an insulating air gap between said segments and said upper section held in that position by said rings.

2. An electrode for an electric arc smelting furnace comprising an upper liquid cooled section, a hollow threaded connecting nipple, and a graphite lower section, (a) said upper section comprising:

1. a cylindrical main structure formed from metal tubing;
2. its upper end comprising a head plate having a cooling liquid inlet and cooling liquid outlets;
3. said inlet comprising tubing connected to an exterior liquid supply, passing through said head plate, connected to the top plate of a metal internal cylinder concentric with said main structure and occupying a majority of the internal volume of said main structure;
4. said internal cylinder serving as a liquid reservoir, heat sink, and passageway for cooling liquid;
5. said internal cylinder having a bottom plate connected with liquid outlet tubing extending to the interior cavity of said nipple;
6. said liquid inlet, internal cylinder, and outlet tubing forming liquid inflow means for cooling said nipple;
7. said nipple being threaded in place in a metal female socket comprising the lower end of said main structure;
8. a first annulus between said outlet tubing and said nipple communicating with a second annulus between the upper end of said socket and the bottom face of said bottom plate defined by spacers;
9. said second annulus communicating with a third annulus defined by the inside wall of said main structure and the outside wall of said internal cylinder;
10. said third annulus connected with cooling liquid outlets on said upper main top plate;
11. said annuli forming cooling liquid outflow means;
12. the exterior of the electrical contact area comprising the major upper portion of said main structure having a plurality of graphite covering ring segments of a thickness effective to conduct the electrode current;
13. said segments being beveled at their upper and lower edges and held in place by circumferential metal rings having a complementary bevel angle in a loose fit such that when no external pressure is applied said segments fall away from said main structure wall, leaving an air gap between said segments and said main structure;
14. said segments being held in place by vertical ribs attached to said main structure fitting in matching grooves in said graphite segments;
15. the lower portion of said main structure being insulated with a series of refractory rings having an inside diameter slightly larger than the outside diameter of said main structure, notched at the lower inside radius to match the dimension of a metal retaining ring;
16. the annulus between said refractory rings and said main structure occupied by refractory fiber insulation covered with radiation reflective insulation;

(b) said nipple being hollow, metal, and threaded, defining a cavity having its upper end open and lower end closed;

(c) said lower section being a column comprising one or more graphite electrode sections.

3. The electrode of claims 1, or 2 wherein the upper liquid cooled main section comprising the main tubing, upper end plate, internal cylinder and nipple socket are constructed of aluminum.

4. The electrode of claims 1, or 2 wherein the lower outlet tube is terminated by a closed lower end with coolant ports through the side and bottom effective to discharge the major portion of the coolant horizontally and a minor portion of the coolant downward.

5. The electrode of claim 4 wherein approximately 80% of the coolant is discharged horizontally and approximately 20% of the coolant is discharged downward.

* * * * *